US012527404B1

(12) United States Patent
Gray-Moore

(10) Patent No.: US 12,527,404 B1
(45) Date of Patent: Jan. 20, 2026

(54) CEILING PAINTER NECK SUPPORT

(71) Applicant: Janet Gray-Moore, Port Clinton, OH (US)

(72) Inventor: Janet Gray-Moore, Port Clinton, OH (US)

( * ) Notice: Subject to any disclaimer, the term of this patent is extended or adjusted under 35 U.S.C. 154(b) by 0 days.

(21) Appl. No.: 18/663,303

(22) Filed: May 14, 2024

(51) Int. Cl.
*A47C 16/00* (2006.01)
*A47F 3/04* (2006.01)

(52) U.S. Cl.
CPC ..... *A47C 16/00* (2013.01); *A47F 3/04* (2013.01)

(58) Field of Classification Search
CPC .. A47C 16/00; A47C 7/36; A47C 7/38; A47C 7/383
See application file for complete search history.

(56) References Cited

U.S. PATENT DOCUMENTS 98,859 A * 1/1870 Fast ..... A47C 7/383 5/636
138,463 A * 4/1873 Wright ..... A47C 7/383 297/393
357,915 A * 2/1887 Ferry ..... A47C 7/383 297/393
382,949 A * 5/1888 Campbell ..... A47C 7/383 297/394
1,510,187 A * 9/1924 Martin ..... B60N 2/882 297/393
2,223,276 A * 11/1940 Ward ..... A61F 5/055 297/484
3,657,739 A * 4/1972 Holmes, Sr. ..... A41D 13/0512 2/467
4,972,982 A * 11/1990 Harbour ..... B44D 3/14 224/617
5,551,081 A * 9/1996 Starnes ..... A41D 13/0512 2/468
5,738,640 A * 4/1998 Carlson-Orsi ..... A61F 5/01 128/845
5,746,705 A * 5/1998 Sheppard ..... A61F 5/3738 602/5
6,135,973 A * 10/2000 Zapletal ..... A61F 5/3792 602/18
6,213,967 B1 * 4/2001 Zapletal ..... A61F 5/055 602/18
6,308,345 B1 * 10/2001 Williams, Jr. ..... A41D 13/0512 602/17
6,435,617 B1 8/2002 McNair
6,648,191 B2 * 11/2003 Giggleman ..... A45F 3/14 224/259

(Continued)

*Primary Examiner* — Nkeisha Smith
(74) *Attorney, Agent, or Firm* — Cramer Patent & Design, PLLC.; Aaron R. Cramer

(57) ABSTRACT

The ceiling painter neck support may comprise a neck roll, a retainer, a waist buckle, and a chest buckle. The ceiling painter neck support may be adapted to be worn by a user while the user is working above eye level such that the user's head must be tilted back to see the work. The neck roll may be positioned behind the user's neck where the neck roll may be adapted to limit the angle of backward head tilt and to support the user's head, thereby relieving stress on neck muscles. The retainer may hold the neck roll in place. The waist buckle may secure the retainer to the front of the user's belt. The chest buckle may be adapted to prevent the ceiling painter neck support from sliding off of the shoulders.

2 Claims, 3 Drawing Sheets

(56) References Cited

U.S. PATENT DOCUMENTS 6,748,615 B1 * 6/2004 Tiedemann ..... A47C 7/383 5/636
6,859,965 B1 * 3/2005 Gourd ..... A47C 16/00 5/636
6,957,462 B1 * 10/2005 Wilcox ..... A47C 7/383 5/636
6,976,971 B2 * 12/2005 Scudere ..... A61F 5/3738 602/5
7,197,781 B2 * 4/2007 Ramsbottom ..... A61F 5/055 5/636
7,316,451 B2 * 1/2008 Balensiefer ..... A42B 3/00 297/216.12
7,865,987 B2 * 1/2011 Deetsch ..... A47C 16/00 5/636
7,892,193 B2 * 2/2011 Marchetto ..... A61F 5/055 602/18
8,672,818 B2 * 3/2014 Welch ..... A61H 1/0296 482/132
8,708,416 B2 * 4/2014 Stronconi ..... A47C 7/383 297/397
8,827,361 B2 * 9/2014 Roybal ..... B60N 2/2839 297/216.11
8,845,565 B1 * 9/2014 Burns ..... A61F 5/3738 602/5
9,332,795 B1 * 5/2016 Jung ..... A41D 13/0512
9,526,360 B2 * 12/2016 Sternlight ..... A47G 9/10
9,737,158 B2 * 8/2017 Kreppein ..... A47C 16/00
10,131,317 B1 * 11/2018 Harrington ..... B60N 2/265
10,420,414 B1 * 9/2019 Snyder ..... A45F 3/14
10,537,147 B1 * 1/2020 Ashline ..... A42B 3/08
10,702,035 B2 7/2020 Cooper
10,702,082 B2 * 7/2020 Wong ..... A47G 9/1072
11,045,022 B2 * 6/2021 Mckinney ..... A47C 7/383
11,297,961 B2 * 4/2022 Lowry ..... A47G 9/1027
11,338,951 B1 * 5/2022 Hinkle ..... B65B 67/1238
11,395,537 B2 * 7/2022 Knoblauch ..... B25H 3/00
11,523,927 B2 * 12/2022 Deetsch ..... A61F 5/3707
2006/0005293 A1 * 1/2006 Frey ..... A44B 11/14 2/44
2006/0013976 A1 1/2006 Leiss
2008/0271249 A1 11/2008 Deetsch
2011/0017793 A1 1/2011 Mellion et al.
2012/0062013 A1 3/2012 Weigert
2012/0168472 A1 * 7/2012 Mathews ..... A45F 5/004 224/162

* cited by examiner

CEILING PAINTER NECK SUPPORT

RELATED APPLICATIONS

None.

FIELD OF THE DEVICE

The present disclosure relates to supportive devices worn by individuals engaged in tasks that require extended periods of upward gazing or head tilting. More specifically, the disclosed device pertains to ergonomic supports designed to alleviate physical strain on the neck and spine of users, such as painters and decorators, who frequently work above eye level for prolonged durations. This device is particularly useful in reducing stress and discomfort in the cervical spine and neck muscles while users perform activities such as painting ceilings or installing overhead fixtures.

BACKGROUND OF THE DEVICE

Ceiling painting and similar overhead activities often necessitate that individuals maintain an upward gaze, which can lead to significant physical strain and discomfort in the neck and upper back regions. Traditional methods for alleviating this strain involve periodic rest or the use of general neck supports that are not specifically tailored to the unique demands of overhead work. These methods can be ineffective in providing sustained relief or may interrupt the workflow, leading to decreased productivity and increased physical ailments over time. Furthermore, existing neck supports often lack the necessary adjustments to securely and comfortably maintain an optimal head position for ceiling work, thereby failing to adequately reduce the load on cervical joints and muscles. There exists, therefore, a need for an improved neck support device that specifically addresses the ergonomic challenges faced by individuals engaged in prolonged ceiling painting and similar activities, offering them both comfort and functionality without hindering their work efficiency.

SUMMARY OF THE DEVICE

Embodiments of the present disclosure may include a neck support apparatus for supporting a user's head while painting, including a neck roll configured to support a user's neck. Embodiments may also include a retainer connected to the neck roll. Embodiments may also include a waist buckle coupled to the retainer, configured to secure the retainer to a user's belt. Embodiments may also include belt. Embodiments may also include a chest buckle coupled to the retainer, configured to maintain the position of the retainer on a user's shoulders.

In some embodiments, the neck roll may include a hollow cylindrical cushion. Embodiments may also include a central aperture extending longitudinally through the center of the neck roll. In some embodiments, the retainer may include a flexible strip passing through the central aperture of the neck roll. Embodiments may also include a plurality of lateral projections adapted to couple with the chest buckle.

In some embodiments, the neck roll has a length of 14 inches and an outside diameter ranging from 2.0 to 5.5 inches. In some embodiments, the central aperture of the neck roll has a diameter of at least three-quarters of an inch.

In some embodiments, the waist buckle and the chest buckle each may include a ladder lock fastener for adjusting the tension of the retainer.

In some embodiments, the retainer may be adjustable in length and may include one or more ladder lock fasteners to modify the tension exerted by the neck roll. In some embodiments, the retainer may be made from materials selected from the group consisting of nylon webbing, cotton canvas, polyester webbing, and polypropylene webbing.

In some embodiments, the neck roll material may include one of polyethylene, ethylene-vinyl acetate, and polyvinyl chloride. In some embodiments, the neck support apparatus may include a means for securing each end of the retainer to the user's belt via the front belt loops of the user's pants, thereby providing stability to the neck roll when the user's head may be tilted backward.

An embodiment may also consist of a retainer connected to the neck roll, including a flexible strip made from materials selected from the group consisting of nylon webbing, cotton canvas, polyester webbing, and polypropylene webbing, passing through the central aperture of the neck roll and including multiple lateral projections adapted to couple with a chest buckle. A waist buckle coupled to the retainer, configured to secure the retainer to a user's belt via the front belt loops of the user's pants, each end of the retainer being securable to enhance stability of the neck roll when the user's head may be tilted backward. The waist buckle includes a ladder lock fastener for adjusting the tension of the retainer, and the chest buckle is coupled to the retainer via lateral projections configured to maintain the position of the neck support apparatus on the user's shoulders.

DESCRIPTION OF THE DRAWINGS

The advantages and features of the present device will become better understood with reference to the following more detailed description and claims taken in conjunction with the accompanying drawings, in which like elements are identified with like symbols, and in which:

DESCRIPTIVE KEY

Figure 1:
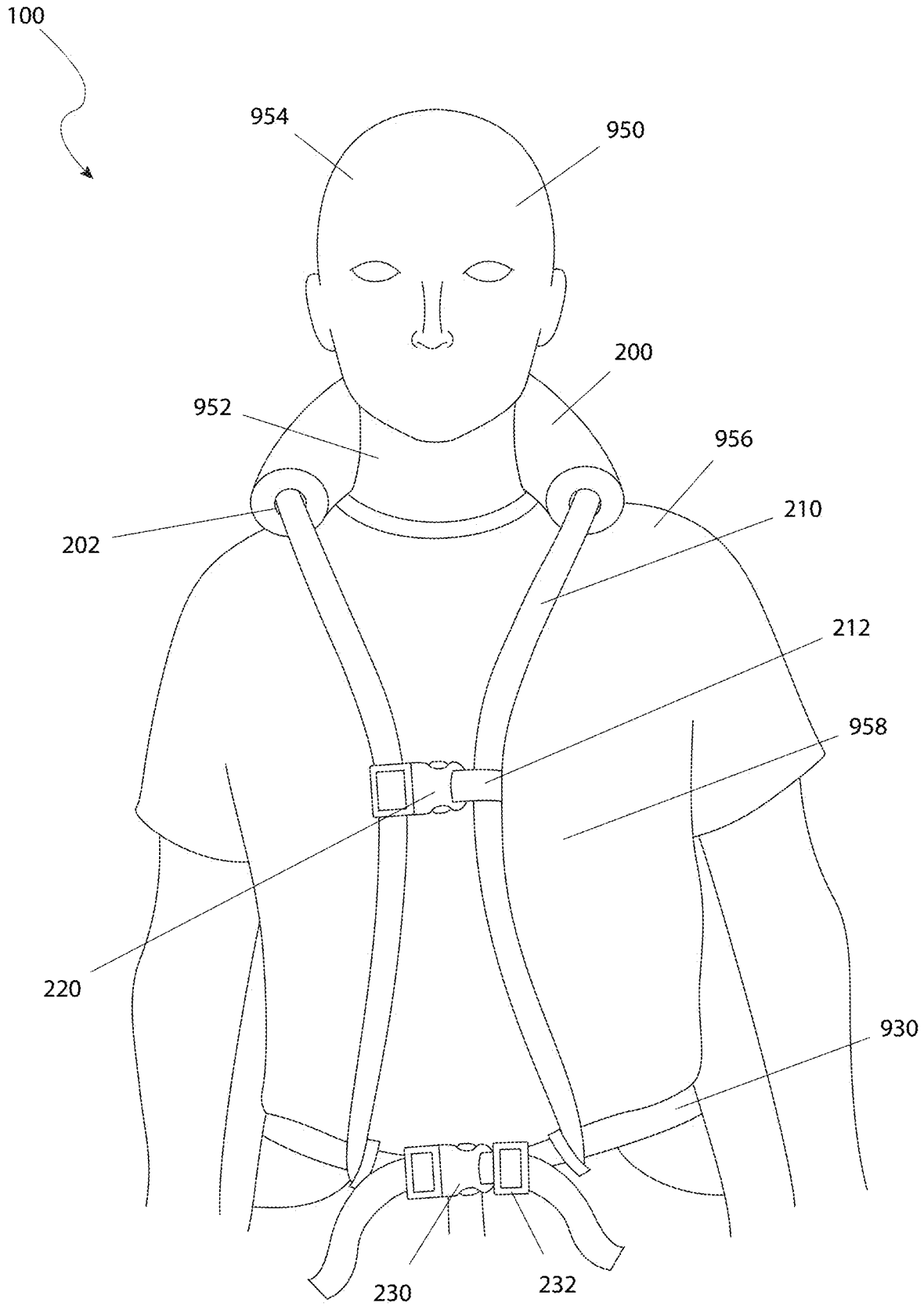
FIG. 1 is a front in-use view of a ceiling painter neck support 100, according to an embodiment of the present device.
Figure 2:
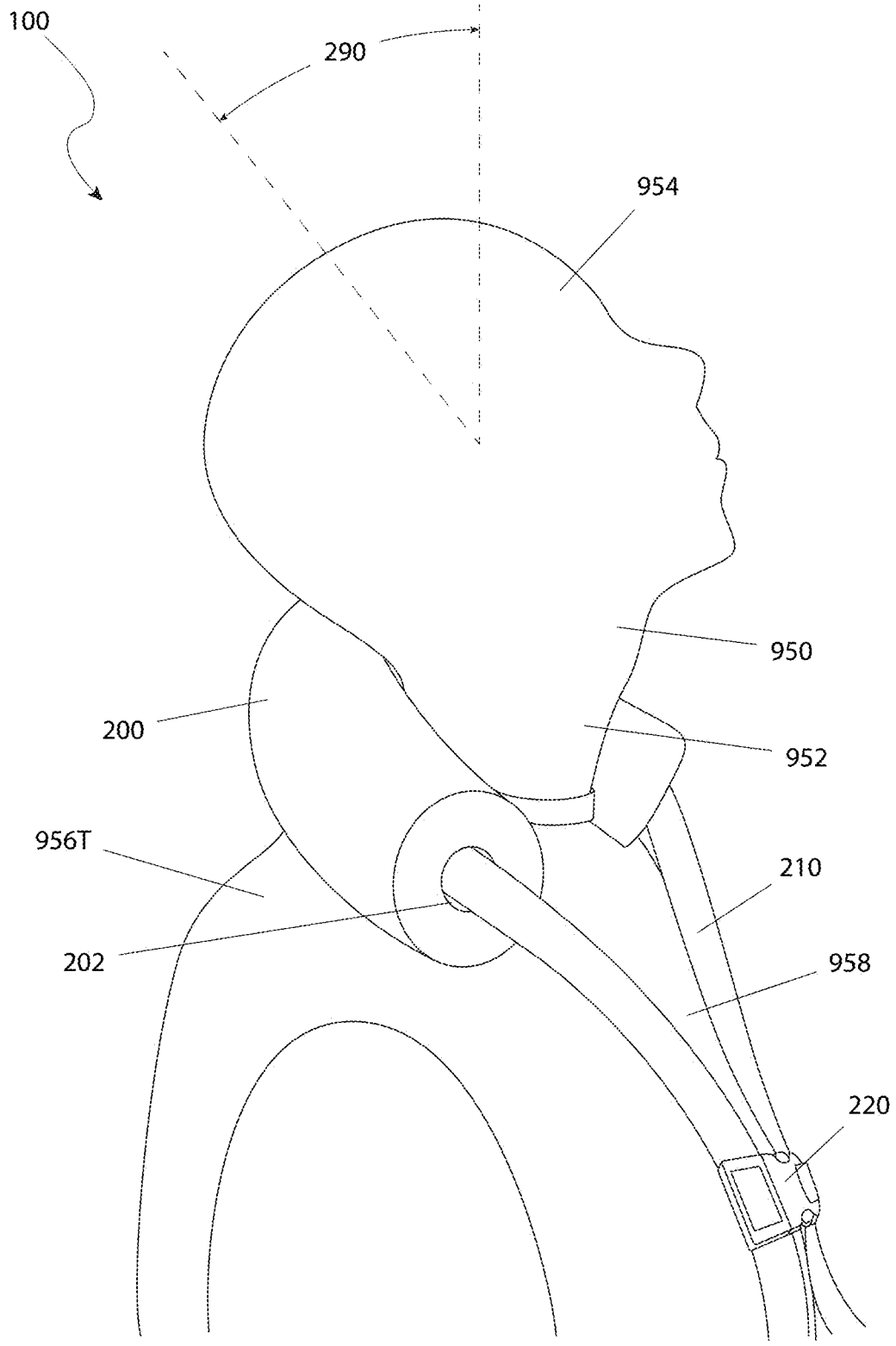
FIG. 2 is an isometric in-use view of a ceiling painter neck support 100, according to an embodiment of the present device.
Figure 3:
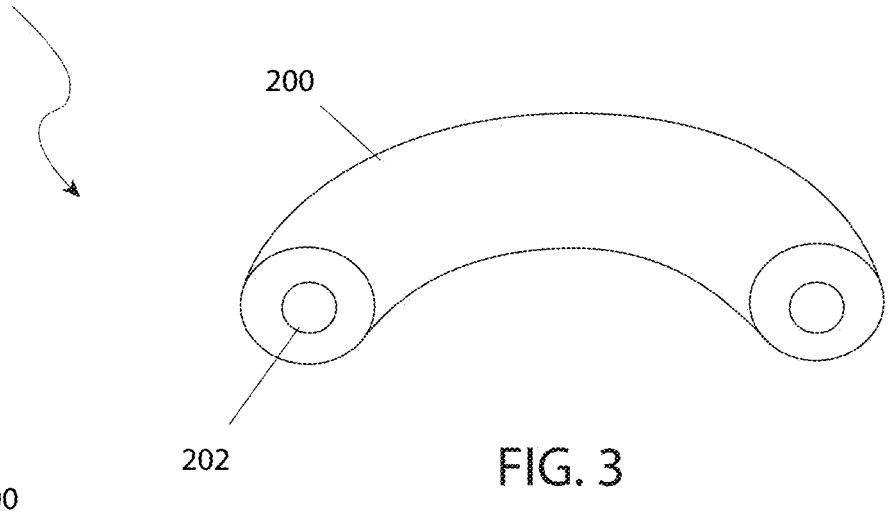
FIG. 3 is a front isometric view of a ceiling painter neck support 100, according to an embodiment of the present device, illustrating the neck roll 200; and, FIG. 4 is a front isometric view of a ceiling painter neck support 100, according to an embodiment of the present device, illustrating the retainer 210, the chest buckle 220, and the waist buckle 230.
Figure 4:
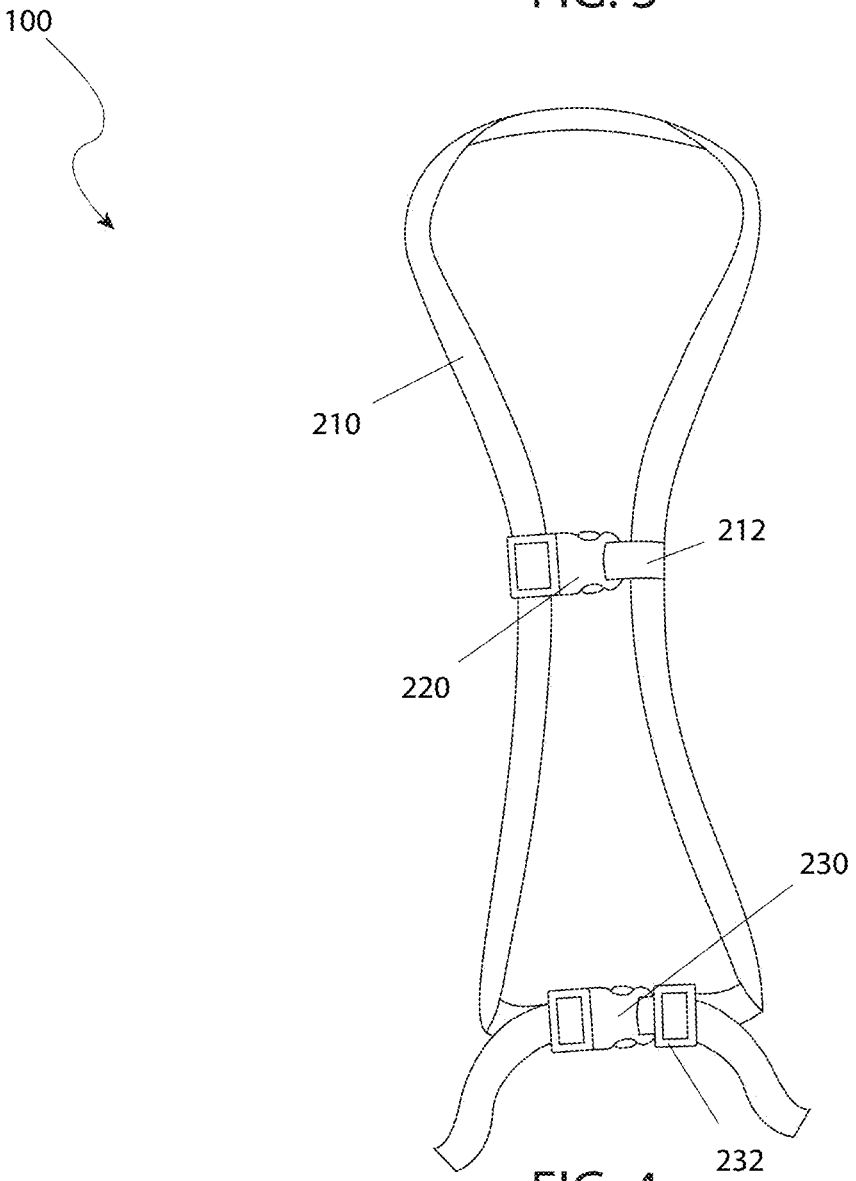

100 ceiling painter neck support
200 neck roll
202 central aperture
210 retainer
212 lateral projection
220 chest buckle
230 waist buckle
232 ladder lock fastener
290 angle of backward head tilt
930 user's belt
950 user

952 user's neck
954 user's head
956 shoulders
958 torso

1. Description of the Device

The present device is directed to a ceiling painter neck support (herein described as the "device") 100. The device 100 may comprise a neck roll 200, a retainer 210, a waist buckle 230, and a chest buckle 220. The device 100 may be adapted to be worn by a user 950 while the user 950 is working above eye level such that the user's head 954 must be tilted back to see the work. The neck roll 200 may be positioned behind the user's neck 952 where the neck roll 200 may be adapted, either by tightening or loosening, to support the user's head 954 and user's neck 952 at a backward head tilt 290 in a necessary position to look upward. The neck roll 200 is particularly suited for taking the weight of the head of the user 950, off of the cervical spine joints, and the cervical spine nerves, as well as allowing the muscles in the user's neck 952 to relax which reduces stress. The retainer 210 may hold the neck roll 200 in place. The waist buckle 230 may secure the retainer 210 to the front of the user's belt 930. The chest buckle 220 may be adapted to prevent the device 100 from sliding off of the shoulders 956. As a non-limiting example, the user 950 may be a painter.

The neck roll 200 may be a hollow cylindrical cushion. The neck roll 200 may comprise a central aperture 202. The central aperture 202 may pass longitudinally through the center of the neck roll 200. As non-limiting examples, the neck roll 200 may have a length of fourteen inches with an error of one inch (14.0 in. +/−1.0 in.) and an outside diameter of two to five and one-half inches (2.0-5.5 in.). As a non-limiting example, the central aperture 202 may have a diameter of at least three-quarters of an inch (¾ in.).

In some embodiments, the neck roll 200 may be made from a plastic foam. As non-limiting examples, the plastic foam may comprise polyethylene (PE), ethylene-vinyl acetate (EVA), or polyvinyl chloride (PVC).

The retainer 210 may be a flexible strip that may pass through the central aperture 202 of the neck roll 200 such that the center of the retainer 210 is located inside of the center of the neck roll 200. The ends of the retainer 210 may be adapted to pass forward from the neck roll 200, over the shoulders 956, and down in front of the torso 958. The ends of the retainer 210 may be coupled with the user's belt 930 via the front belt loops to maintain tension that holds the neck roll 200 in place. As a non-limiting example, the ends of the retainer 210 may be drawn through the user's belt loops and the ends of the retainer 210 may be fastened to each other. In some embodiments, the length of the retainer 210 may be adjusted using one (1) or more ladder lock fasteners 232 in order to change the tension on the neck roll 200.

As a non-limiting example, the retainer 210 may have a length of six and one-half feet with an error of one foot (6.5 ft. +/−1.0 ft.).

In some embodiments, the retainer 210 may be a strap of webbing. As non-limiting examples, the retainer 210 may be nylon webbing, cotton webbing such as canvas, polyester webbing, polypropylene webbing, or any combination thereof.

The retainer 210 may comprise the waist buckle 230. As a non-limiting example, a first half of the waist buckle 230 may be coupled to each end of the retainer 210. The ends of the retainer 210 may then be strung through the loops of pants where the user's belt 930 is routed and the waist buckle 230 may be self-fastenable and located at a midpoint to secure the retainer 210 to the user 950.

The chest buckle 220 may be adapted to be positioned in front of the torso 958 and between the ends of the retainer 210. The chest buckle 220 may be operable to couple the left side of the retainer 210 to the right side of the retainer 210 such that the retainer 210 is less likely to slide off of the shoulders 956. In some embodiments, the chest buckle 220 may be coupled to the retainer 210 via one (1) or more lateral projections 212 of the retainer 210.

As non-limiting examples, the waist buckle 230, the chest buckle 220, or both may be a snap-lock buckle.

In use, a user 950 who is preparing to paint the ceiling or upper walls in a room may don the device 100 by placing the neck roll 200 behind the user's neck 952, passing the ends of the retainer 210 forward over the shoulders 956 and down in front of the torso 958, passing the ends of the retainer 210 through the loops of the pants where the user's belt 930 is routed, fastening the waist buckle 230, and fastening the chest buckle 220. The tension on the neck roll 200 may be adjusted at the user's waist level by tightening or loosening the retainer 210 via the ladder lock fastener 232 on each side of the waist buckle 230. With the neck roll 200 in place behind the user's neck 952, the user's head 954 may tilt back at the angle of backward head tilt 290 with the weight of the user's head 954 being supported by the neck roll 200 and reducing stress on the cervical joints, cervical nerves, and neck muscles.

In an embodiment of the present invention, the ceiling painter neck support device (100) consists of the following integrated components specifically designed to support the user (950) during tasks requiring upward gazing, such as ceiling painting. The device includes a neck roll (200) equipped with a central aperture (202) that is positioned behind the user's neck (952) to facilitate a comfortable fit and adequate support. The neck roll (200) is secured in place by a retainer (210), a flexible strip that passes through the central aperture (202) and extends over the user's shoulders (956) to the front of the torso (958). This retainer (210) includes lateral projections (212) which connect to a chest buckle (220), strategically positioned to prevent the device from sliding off the user's shoulders. The retainer (210) is further secured by a waist buckle (230) fastened to the user's belt (930), with the addition of ladder lock fasteners (232) for adjustable tension. This arrangement maintains the user's head (954) in a backward tilt (290) as required for viewing overhead tasks, effectively redistributing the weight and reducing strain on the cervical spine and neck muscles.

The exact specifications, materials used, and method of use of the device 100 may vary upon manufacturing. The foregoing descriptions of specific embodiments of the present device have been presented for purposes of illustration and description. They are not intended to be exhaustive or to limit the device to the precise forms disclosed, and obviously many modifications and variations are possible in light of the above teaching. The embodiments were chosen and described in order to best explain the principles of the device and its practical application, to thereby enable others skilled in the art to best utilize the device and various embodiments with various modifications as are suited to the particular use contemplated.

The invention claimed is:

1. A ceiling painter neck support apparatus comprising:

a neck roll having a central aperture extending longitudinally therethrough, the neck roll having a length of fourteen inches±one inch and an outside diameter ranging from 2.0 to 5.5 inches, the neck roll configured to be positioned behind a user's neck to support a backward head tilt of the user during ceiling painting;

a retainer in the form of a flexible strip passing through the central aperture of the neck roll, the retainer including lateral projections;

a chest buckle coupled to the retainer via the lateral projections and configured to prevent the retainer from sliding off the user's shoulders; and, a waist buckle coupled to the retainer, each end of the retainer being securable through front belt loops of the user's pants and fastened by the waist buckle, thereby stabilizing the neck roll against upward displacement when the user's head is tilted backward.

2. The ceiling painter neck support apparatus of claim 1, wherein the retainer comprises a strap of webbing selected from the group consisting of nylon webbing, cotton canvas, polyester webbing, and polypropylene webbing, and wherein the neck roll is formed from a plastic foam material selected from the group consisting of polyethylene, ethylene-vinyl acetate, and polyvinyl chloride.

* * * * *